US007748477B2

(12) United States Patent
Youn

(10) Patent No.: US 7,748,477 B2
(45) Date of Patent: Jul. 6, 2010

(54) BORING SYSTEM AND METHOD THEREFOR

(75) Inventor: Eun-Jung Youn, Seoul (KR)

(73) Assignee: Kolon Construction Co., Ltd. (KR)

( * ) Notice: Subject to any disclaimer, the term of this patent is extended or adjusted under 35 U.S.C. 154(b) by 597 days.

(21) Appl. No.: 10/591,262

(22) PCT Filed: Feb. 22, 2005

(86) PCT No.: PCT/KR2005/000482

§ 371 (c)(1),
(2), (4) Date: May 31, 2007

(87) PCT Pub. No.: WO2005/085579

PCT Pub. Date: Sep. 15, 2005

(65) Prior Publication Data

US 2008/0017418 A1 Jan. 24, 2008

(30) Foreign Application Priority Data

Mar. 5, 2004 (KR) ..... 10-2004-0015167

(51) Int. Cl.
*E21B 3/02* (2006.01)

(52) U.S. Cl. ..... 175/108; 175/220

(58) Field of Classification Search ..... 175/77, 175/78, 108, 220
See application file for complete search history.

(56) References Cited

U.S. PATENT DOCUMENTS 358,202 A * 2/1887 Jones ..... 173/32
375,262 A * 12/1887 Covey ..... 173/42
639,267 A * 12/1899 Moss ..... 74/108
4,480,704 A 11/1984 May et al.
6,681,871 B2 1/2004 Drumm et al.

FOREIGN PATENT DOCUMENTS

| | | |
|---|---|---|
| JP | S49-028108 | 3/1974 |
| JP | S52-070514 | 6/1977 |
| JP | 7018664 | 1/1995 |
| JP | 07-324584 | 12/1995 |
| JP | 9170246 | 6/1997 |
| JP | 9228770 | 9/1997 |
| KR | 10-2002-0019662 | 3/2002 |
| KR | 10-2003-0092241 | 6/2003 |

OTHER PUBLICATIONS

International Search Report dated Jul. 11, 2005.

* cited by examiner

*Primary Examiner*—William P Neuder
(74) *Attorney, Agent, or Firm*—Ostrolenk Faber LLP

(57) ABSTRACT

A boring system and method for same, relating to the boring system and method therefor, in particular to the boring system and method therefor for forming boring holes on the ground, which includes a bit unit for boring the ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in a longitudinal direction, is disclosed.

28 Claims, 12 Drawing Sheets

[Fig. 1]
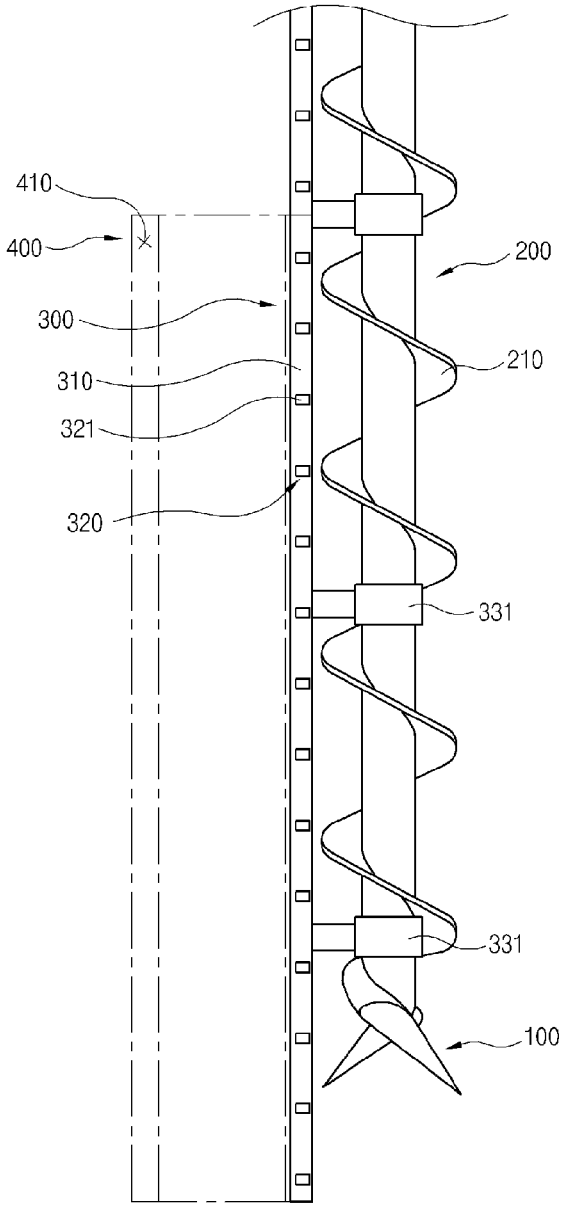
[Fig. 2]
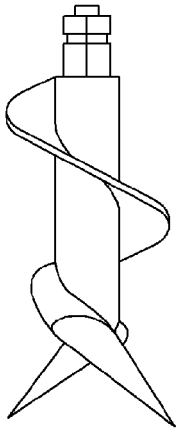

[Fig. 3]
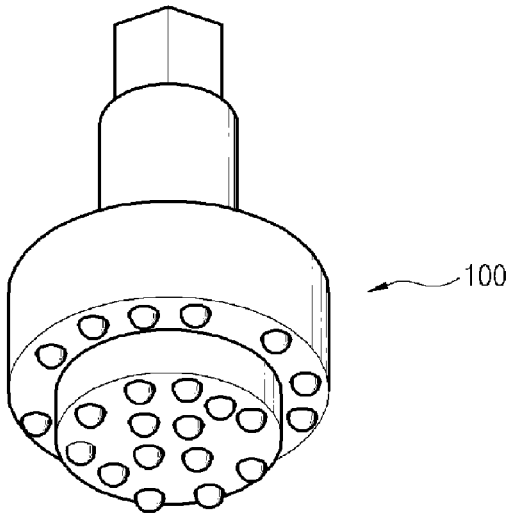
[Fig. 4]
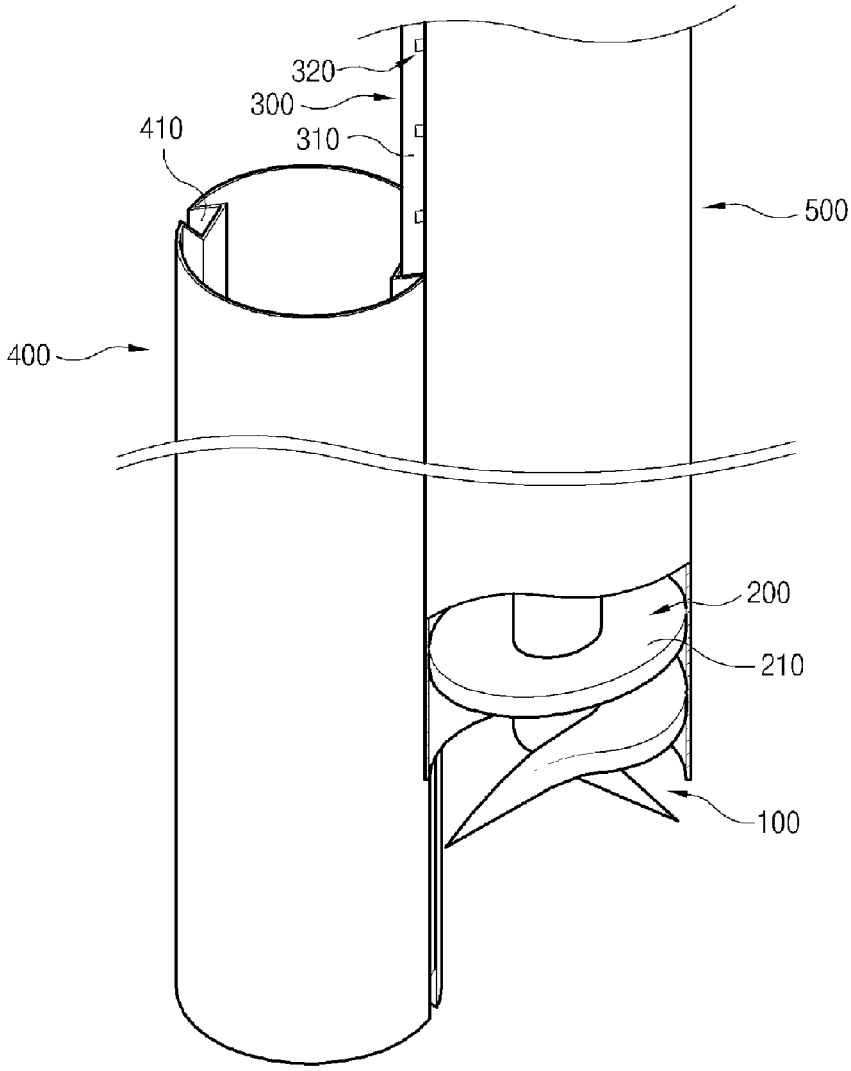

[Fig. 5]
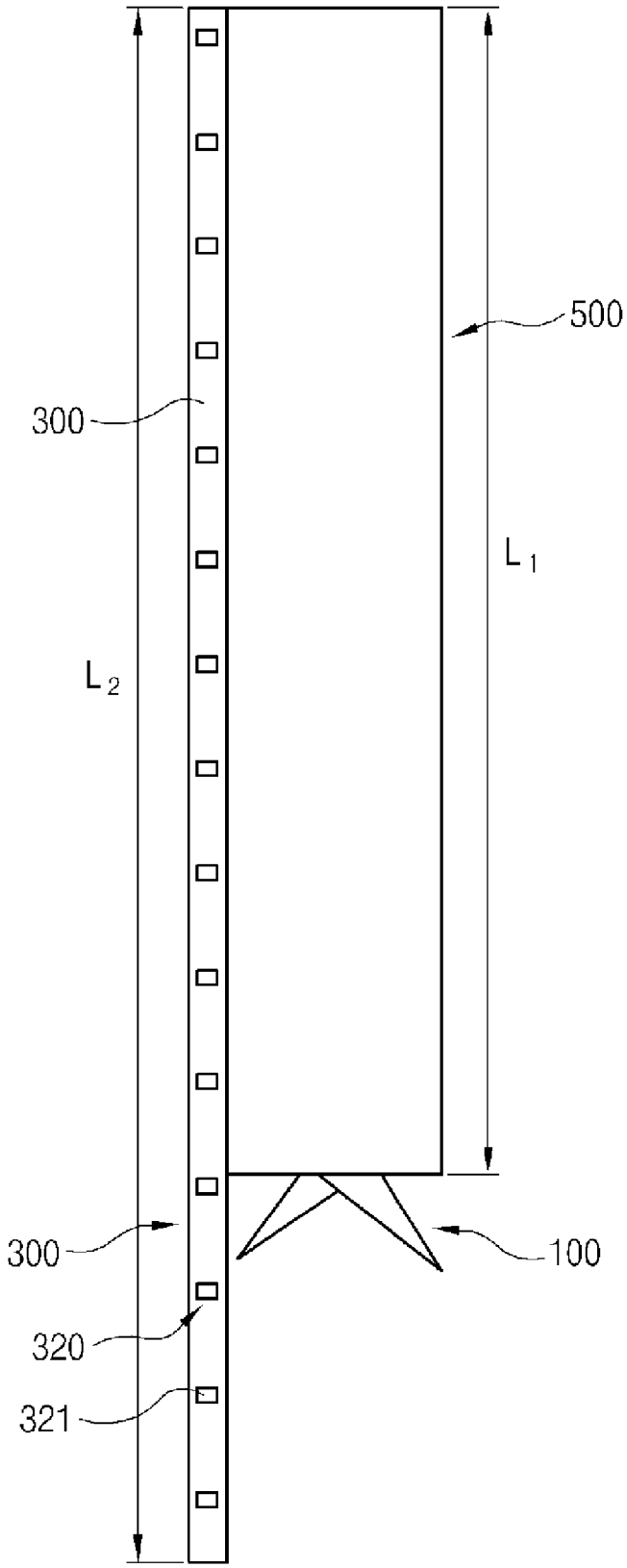

[Fig. 6]
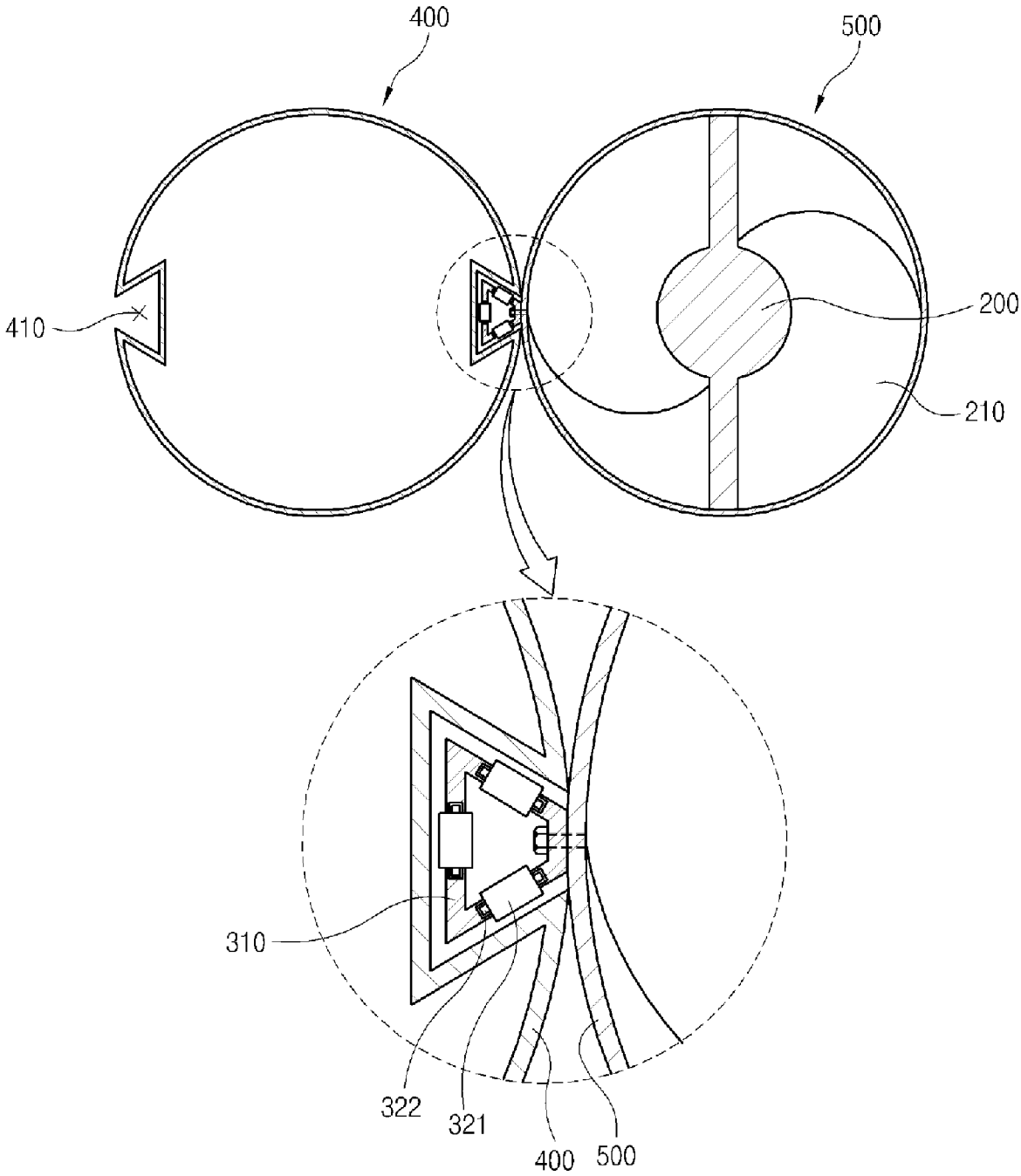

[Fig. 7]
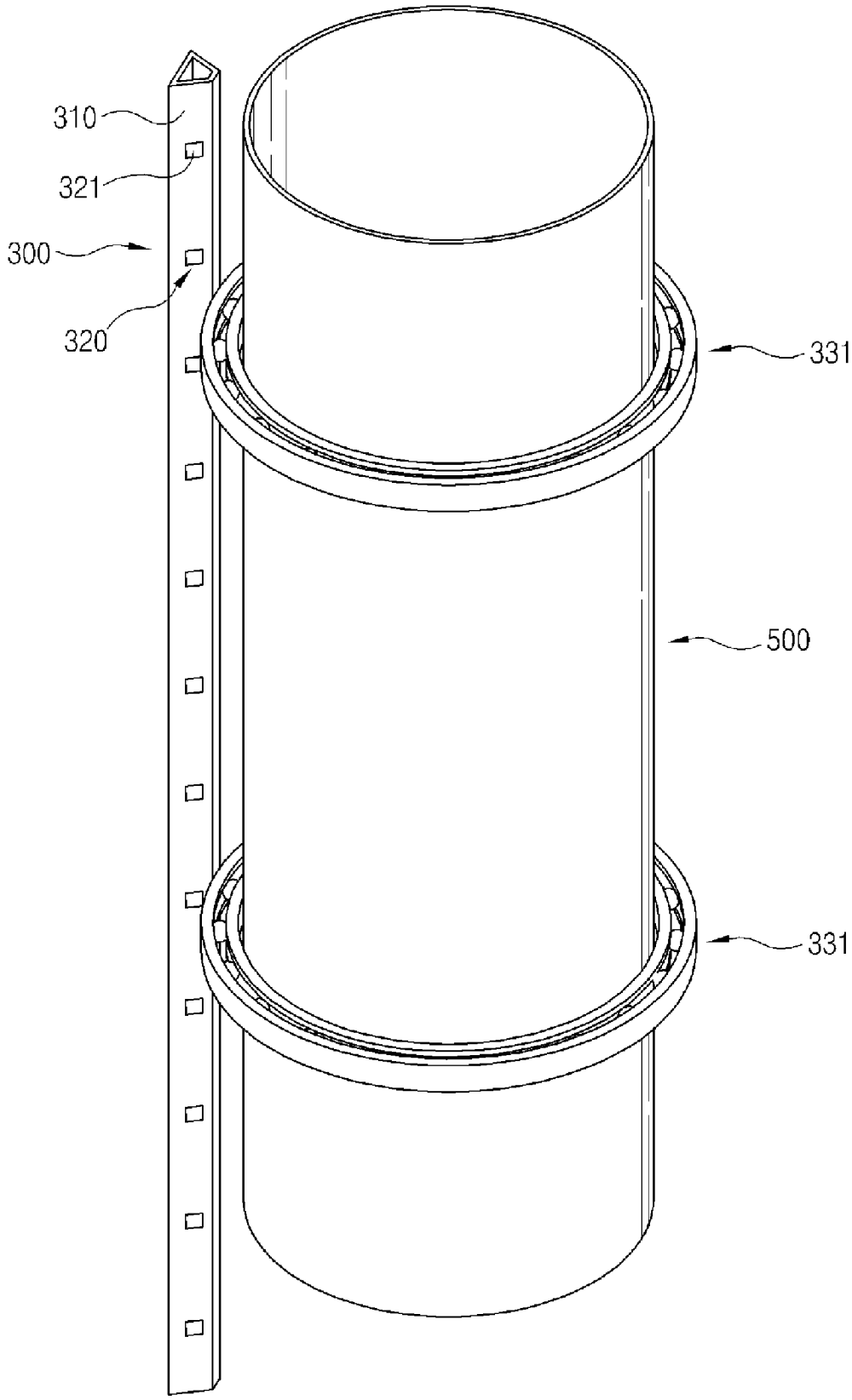

[Fig. 8]
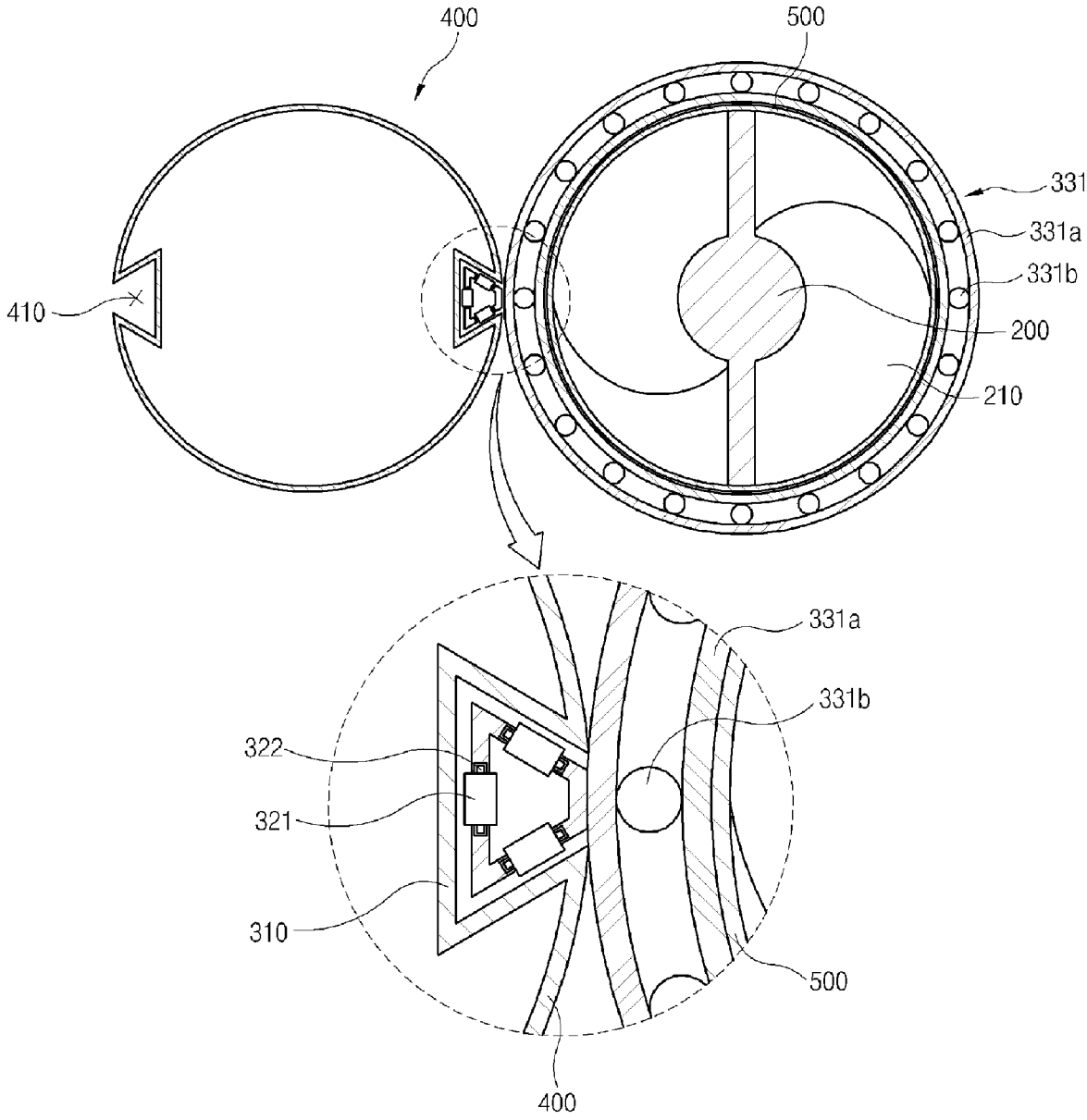

[Fig. 9]
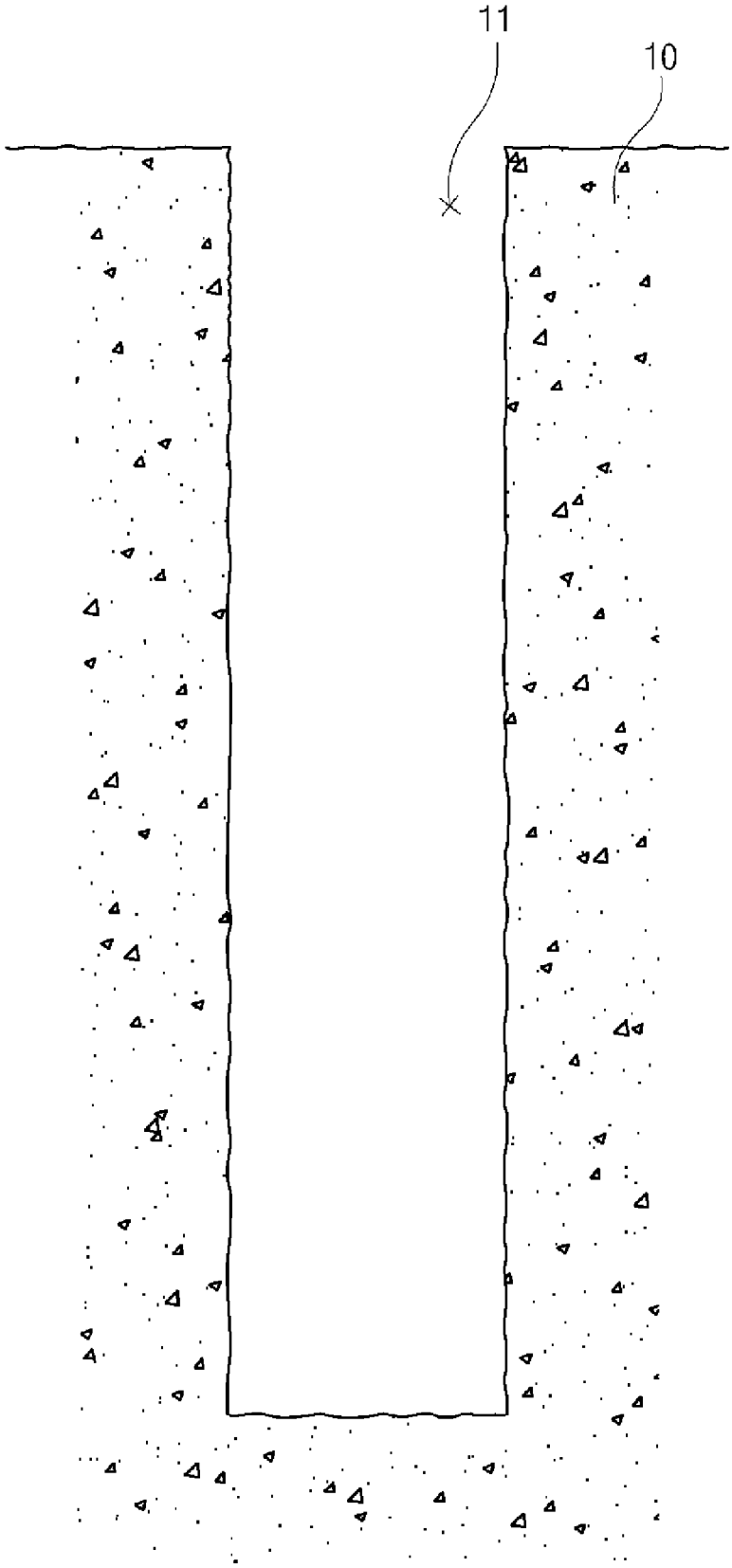

[Fig. 10]
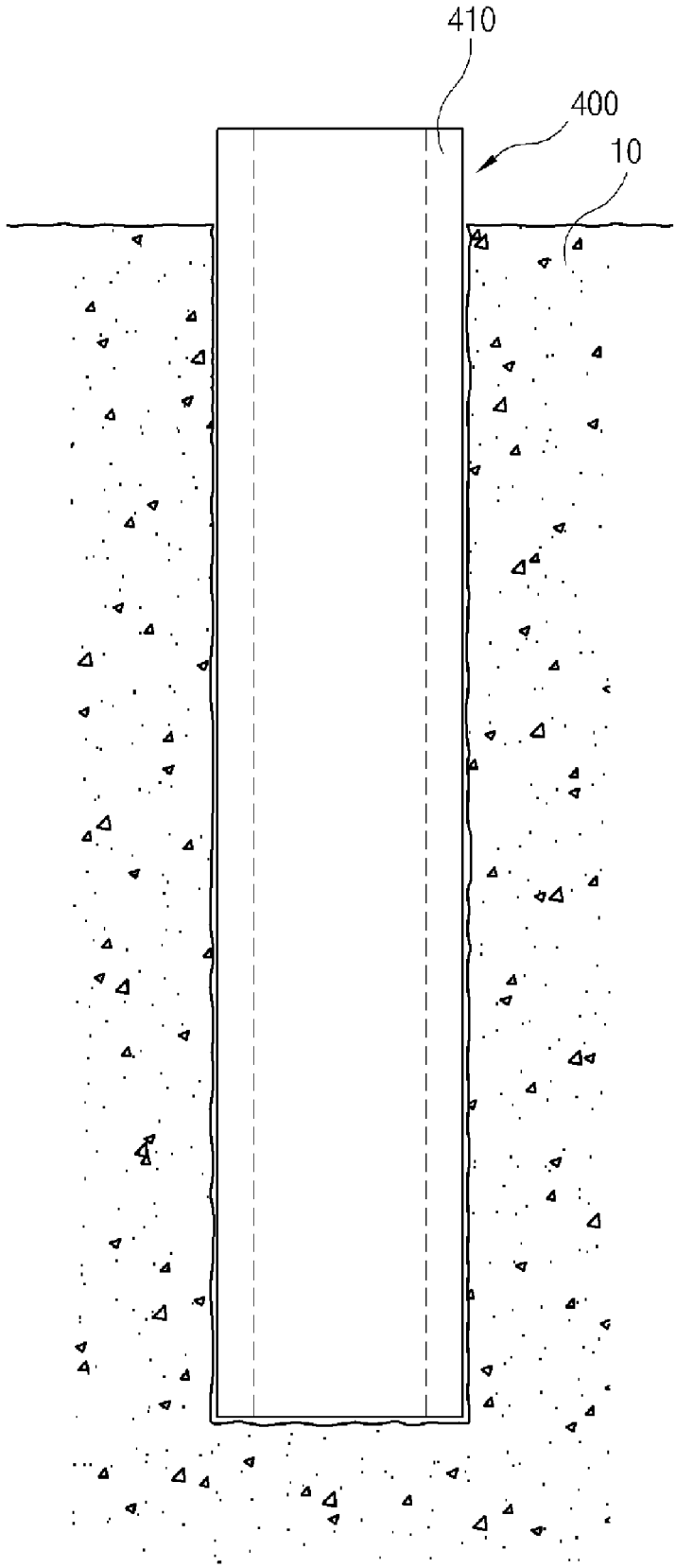

[Fig. 11]
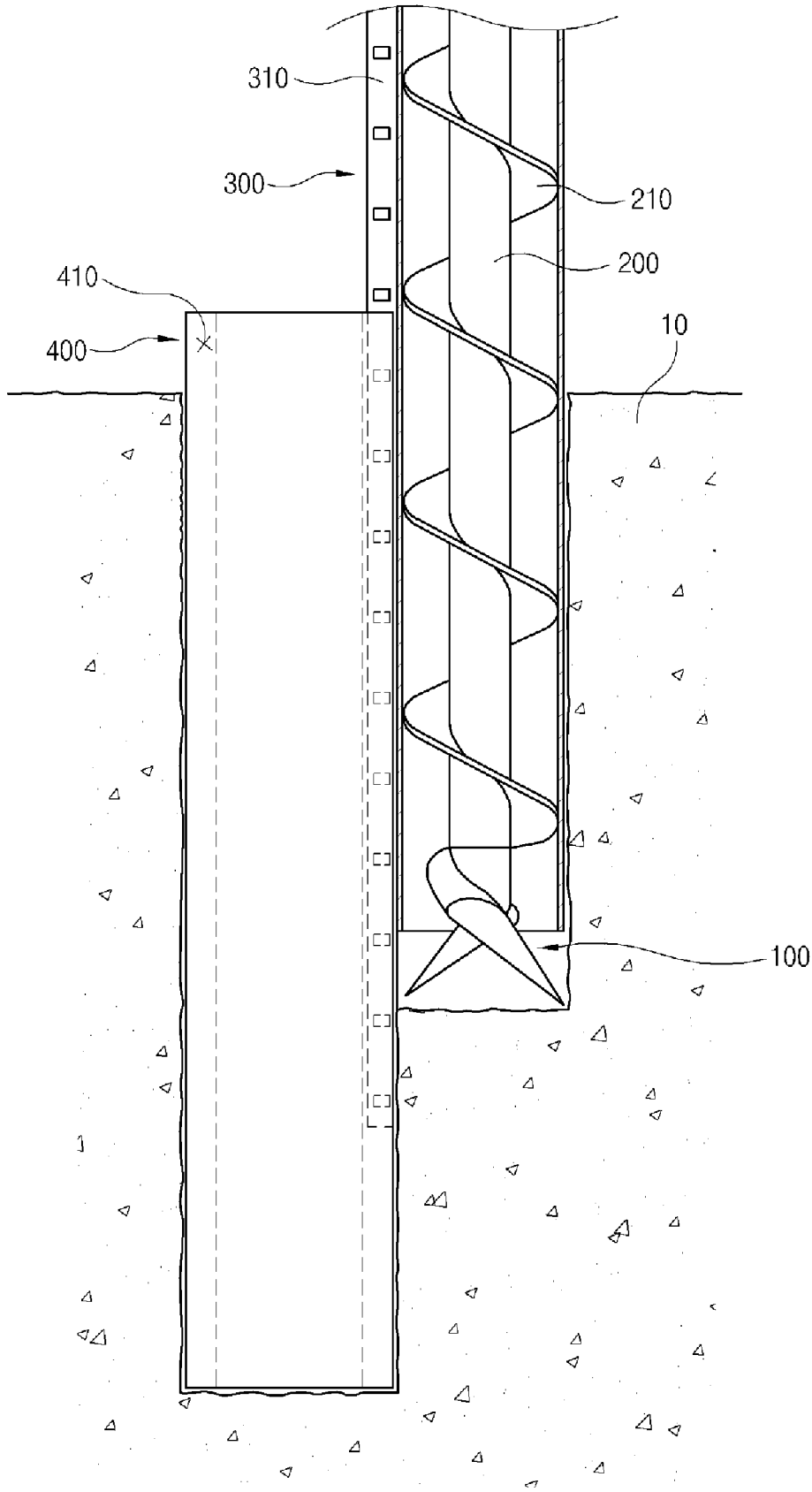

[Fig. 12]
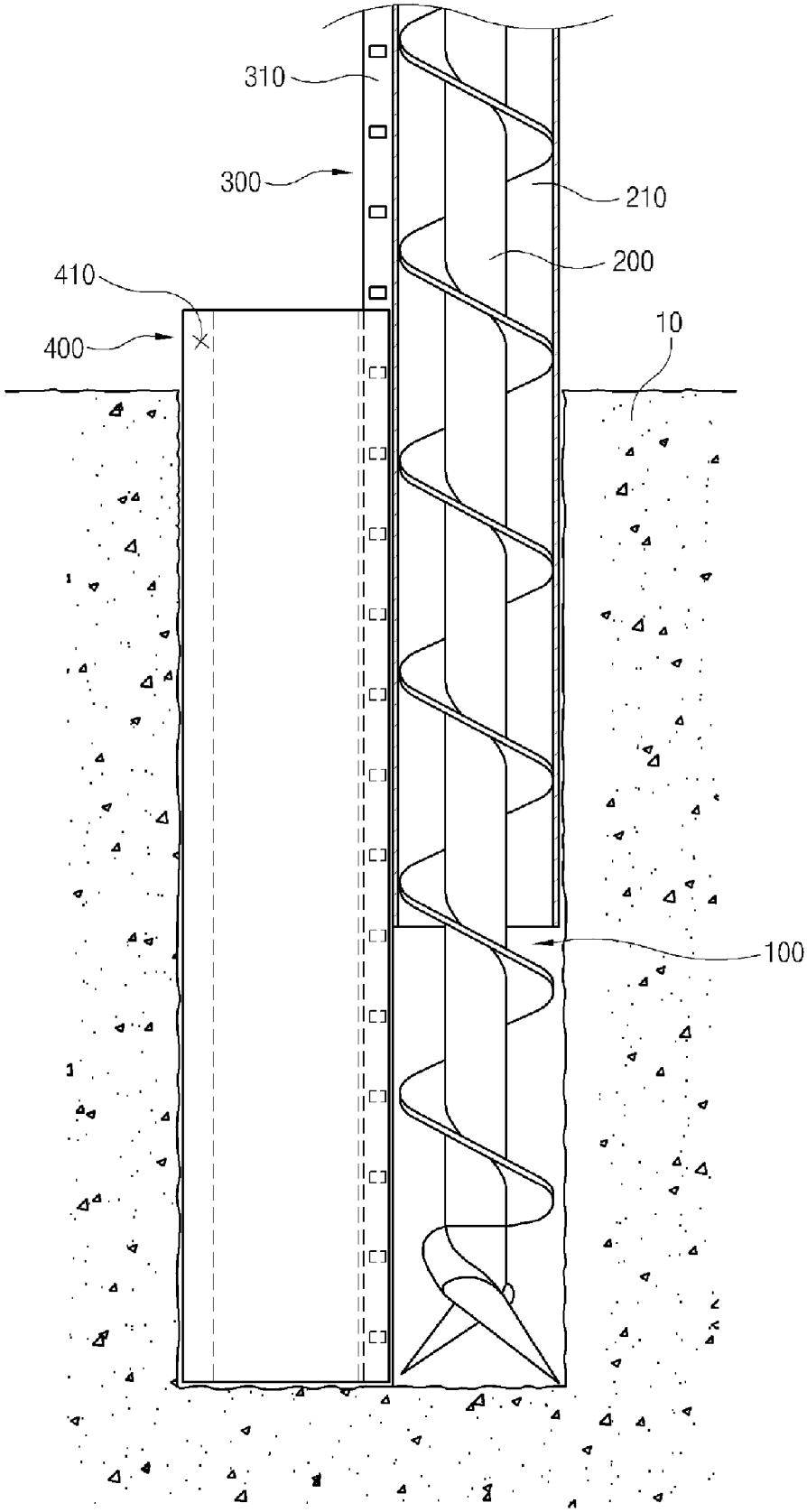

[Fig. 13]
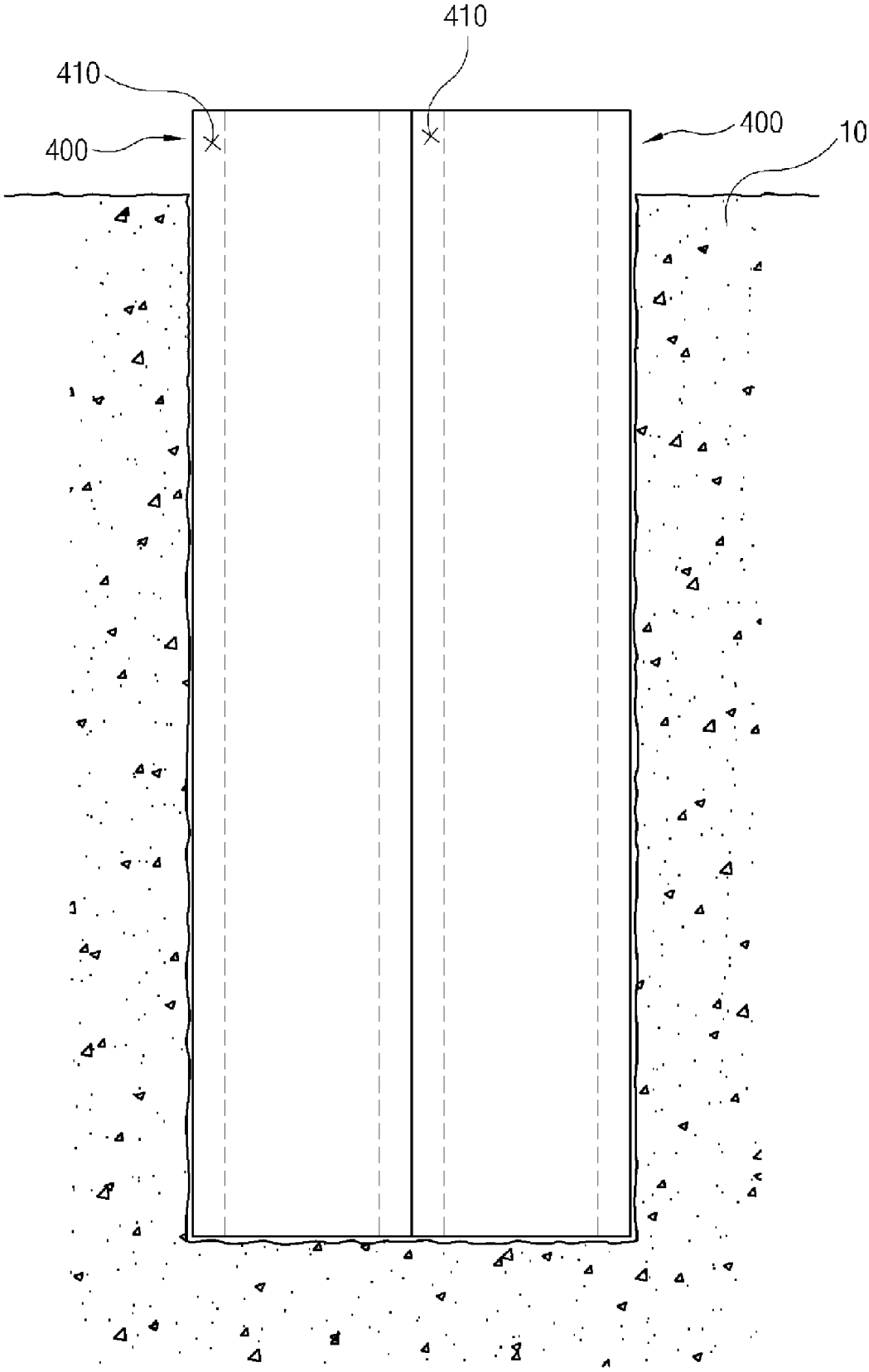

[Fig. 14]
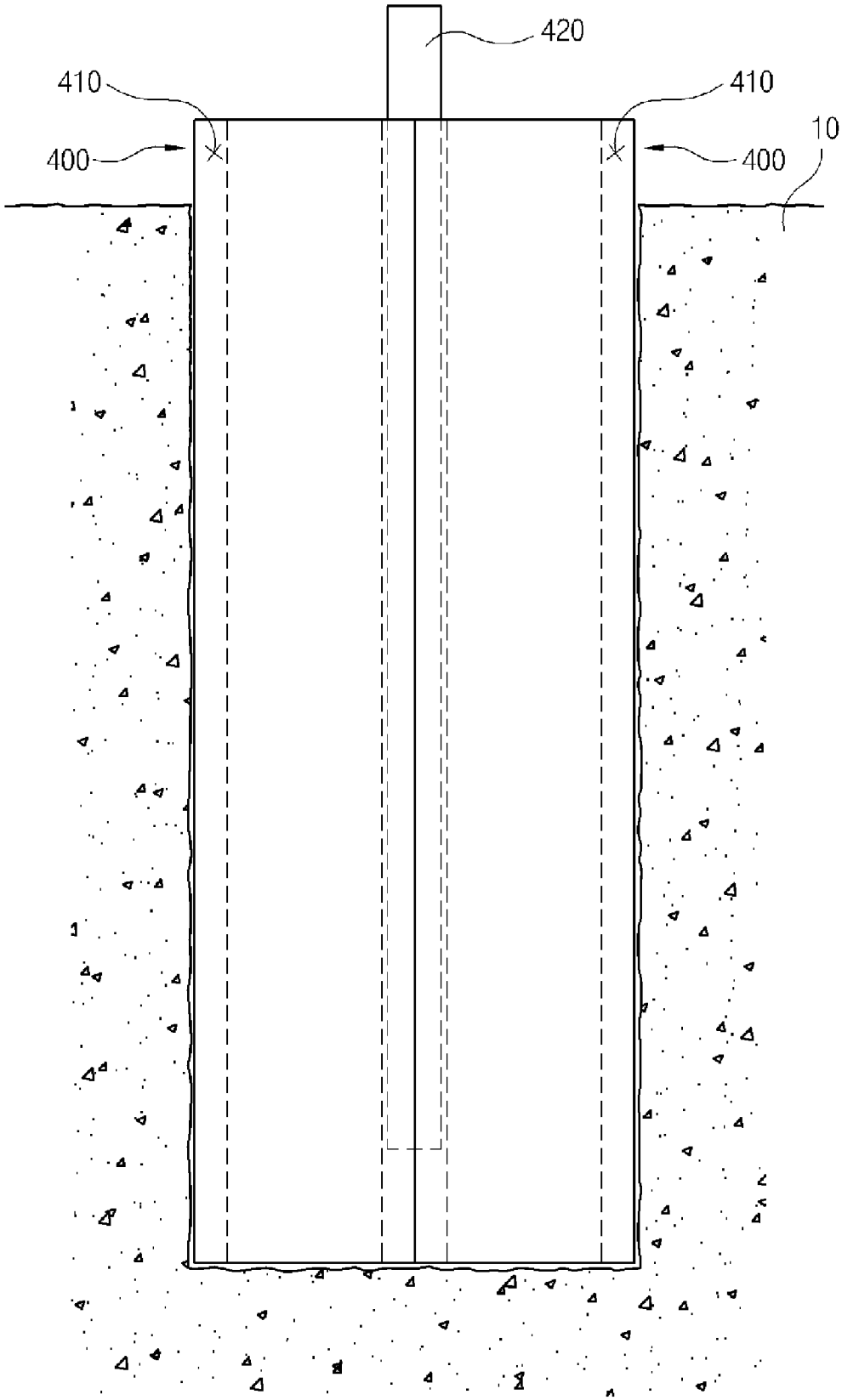

BORING SYSTEM AND METHOD THEREFOR

CROSS REFERENCE TO RELATED APPLICATION

The present application is a 35 U.S.C. §§371 national phase conversion of PCT/KR2005/000482, filed 22 Feb. 2005, which claims priority of Korean Application No. 10-2004-0015167, filed 5 Mar. 2004. The PCT International Application was published in the English language.

TECHNICAL FIELD

The present invention relates to a boring system and method for same, in particular to the boring system and method for forming boring holes on the ground.

BACKGROUND ART

Boring is defined as a technology for boring a deep hole in the ground. In order to conduct extracting oil or natural gas, developing geothermal energy or hot springs and ventilation, drainage of water, pumping water, blasting, etc., in addition to a close examination of the earth's crust, such as geological structure of the underground, distribution of rock types, or probes for mineral deposit, the boring is performed. Boring holes of various diameters and various depths may be formed; the boring method by various boring devices may be classified into an impact-type boring and a rotary-type boring.

The impact-type, in that a hole is developed by making a bit suspended to the end of the wire rope at the predetermined height free fall, impacting the bottom of the hole, and crushing the ground, thereby developing the hole vertically into the ground, may be used in relatively shallow boring within hundreds meters depth. The first drilling machine of the impact-type is one invented in 1803 by I. M. Singer of the United States of America. The rotary-type boring, widely used, may bore a hole in any direction. The rotary-type boring may be performed by elongating a steel pipe, called a drilling pipe in a proper length, pressing and rotating a bit fixed to the end of the steel pipe toward the bottom of a hole, and cutting the ground, and the boring hole has reached to 8,000 m in an oil land in U.S.A. The first steam boring machine of this type has been invented around 10 by an English mechanical engineer, called as Trevithick, R. A bit used in the rotary boring, may be selected from a metal bit, a rock bit and a diamond bit according to the hardness of the ground to be bored. A metal bit has an end of ultra hard metal cemented carbide, and a rock bit used in hard rock is comprised of several cone-type rollers having a plurality of protrusions, which crushes rock by wedge functions of the protrusions when rotating over the bottom surface of the hole. As a diamond bit used in hard rock or ultra hard rock, there are one inserted with diamond particles in the end of the blade, and the other having the blade made of mixture of fine diamonds and metal powder sintered under vacuum atmosphere. Both borings use abrasion effect of rock by diamond particles, are called a diamond boring, a boring using a diamond bit Core bits which form circular ring in the earth and leave a core in the center, are widely used in the rotary boring for geological examination. The core, a sample ore of base rock, is used in the close examination for composition or properties of rock. This is called as a core boring. A container, a core tube installed between the core bit and a drilling tube, preserves safety of the core. In the rotary boring, muddy water is injected into the hole though the drilling tube, being sprayed from the end of the bit and then being circulated for cooling the end of the blade, discharging bored dregs and protecting the wall of the hole. In boring the ground having weak layers or layers having gushing water, a casing pipe, a thin steel pipe protects the hole. There is a short ball boring, in which the boring is performed by mixing short balls of small grain in the muddy water, and colliding together, thereby crushing rock. Recently, a tunnel digging machine and a pit excavation machine, as an application of large hole boring, are developed. In particular, a boring is required for strengthening the ground in a tunnel construction, in a building construction such as an apartment, in a structure construction such as a subway, or for forming a wall for blocking soil or water.

Meanwhile, the grounds for being bored or drilled are largely classified into soil layers that have soil and sands and are easily bored, and rock layers that are hard to be bored. And the general grounds include soil layers and rock layers, and the rock layers may curve the boring path when boring.

In other words, in case of the ground including rock layers, soil layers make no deviation in the boring path, but rock layers may make any deviation in the designed boring path due to the hardness of the rock layers.

In particular, this may require an additional working for filling a gap formed between the adjacent piles in order to stopping water leaks in the underground.

DISCLOSURE

Technical Problem

To solve the above problems, it is an object of the present invention to provide a boring system capable of boring according to the design conditions.

It is another object of the present invention to provide a boring method capable of boring according to the design conditions.

Technical Solution

To achieve the above objects, the present invention provides a boring system which includes a bit unit for boring the ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in a longitudinal direction.

The guide unit is a guide rod connected with the connecting rod in one side, and inserted into the guide groove.

A friction reduction unit for reducing friction resistance with the guide groove may be further installed in outer side of the guide rod.

The friction reduction unit may be comprised of a plurality of rollers installed in the outer side of the guide rod.

The guide unit may be comprised of in plural, and the plurality of the guide units may be installed in order in a longitudinal direction of the connecting rod. The cross section of the guide rod may correspond to the cross section of the guide groove.

The width of the cross section of the guide rod may decrease toward a portion thereof connected with the connecting rod.

The cross section of the guide unit may have a 'U' shape of which opening portion of the guide unit is connected with a roller.

The guide unit may be connected with the connecting rod by a screw.

An opening portion of the guide unit may be wider than a connecting portion connected with the connecting rod.

The bit unit may be one of an air hammer and a blade-type bit.

An outer surface of the connecting rod may be formed with a screw.

The guide unit may further include a rotation prevention unit for preventing the guide unit from rotating due to rotation of the connecting rod.

The rotation protection unit may be a bearing.

The bearing may be connected to an outer surface of the connecting rod, and an outer surface of the bearding may be connected with the guide unit.

Also the boring system in accordance with the present invention, may further comprised of an auxiliary casing inserted into the adjacent boring hole and formed with a guide groove along the auxiliary casing in a longitudinal direction for being inserted with the guide unit and guiding the guide unit.

The guide unit may be extended from an end of the bit unit.

Also, the present invention provides a boring system which includes a bit unit for boring the ground, a connecting rod connected with a driving device for transmitting driving force to the bit unit, a main casing inserted with the connecting rod, and a guide unit connected with the outside of the main casing in a longitudinal direction, the guide unit guiding movement of the bit unit along a guide groove which is formed in a casing inserted into an adjacent boring hole in a longitudinal direction.

The guide unit is a guide rod connected with the main casing in one side and inserted into the guide groove.

A friction reduction unit for reducing friction resistance with the guide groove may be further installed in an outer side of the guide rod.

The friction reduction unit may be comprised of a plurality of rollers installed in the outer side of the guide rod.

The guide unit may be comprised of a plurality of the guide units installed in order in a longitudinal direction of the main casing.

The cross section of the guide rod may correspond to the cross section of the guide groove.

The width of the cross section of the guide rod may decrease toward a portion thereof connected with the main casing.

The cross section of the guide unit may have a 'U' shape of which opening portion of the guide unit is connected with a roller.

The guide unit may be connected with the main casing by a screw.

An opening portion of the guide unit may be wider than a connecting portion connected with the main casing.

The bit unit may be one of an air hammer and a blade-type bit.

An outer surface of the connecting rod may be formed with a screw.

The guide unit may be further comprised of a rotation prevention unit for preventing the guide unit from rotating due to rotation of the main casing.

The rotation protection unit may be a bearing.

The bearing may be connected to an outer surface of the main casing, and an outer surface of the bearding may be connected with the guide unit.

The boring system may be further comprised of an auxiliary casing inserted into the adjacent boring hole and formed with a guide groove along the auxiliary casing in a longitudinal direction for being inserted with the guide unit and guiding the guide unit.

The guide unit may be extended from an end of the bit unit.

Also the present provides a boring method which includes first boring step for boring first boring hole in the ground, casing inserting step for inserting a casing formed with a guide groove in a longitudinal direction, and second boring step for boring second boring hole with a bit unit moving along the guide groove of the casing in a longitudinal direction.

Advantageous Effects

The boring system and the boring method in accordance with the present invention may advantageously enhance plumbness of a boring hole when boring the ground.

Also the boring system and the boring method in accordance with the present invention may advantageously prevent a gap from being formed between the boring holes when boring a plurality of boring holes in the ground.

Also advantageously, the boring system and the boring method in accordance with the present invention prevents a gap from being formed between the boring holes, and thereby does not require any additional working for filling a gap formed between the adjacent piles in order to preventing water leaks in the underground when forming a wall for blocking soil or water.

DESCRIPTION OF DRAWINGS

FIG. 1 is a side view of the boring system in accordance with the first embodiment of the present invention.

FIGS. 2 and 3 are respectively prospective views of the bit units used in the boring system in accordance with the present invention.

FIG. 4 is a perspective view of the boring system in accordance with the second embodiment of the present invention.

FIG. 5 is a side view of the boring system in FIG. 4.

FIG. 6 is a cross sectional view of the boring system in FIG. 4.

FIG. 7 is a perspective view of the boring system in FIG. 4 having the rotation prevention unit.

FIG. 8 is a cross sectional view of the boring system in FIG. 7.

FIGS. 9 to 14 are respectively sectional views showing working diagrams of the boring system in accordance with the present invention.

BEST MODE

Hereinafter, the boring system and the boring method according to the present invention will be described with reference to the accompanying drawings.

As shown in FIG. 1, the boring system in accordance with the first embodiment of the present invention, is comprised of a bit unit 100 for boring the ground 10, a connecting rod 200 connected with a driving device (not shown) for transmitting driving force to the bit unit 100, and a guide unit 300 connected with the connecting rod 200 in a longitudinal direction, the guide unit 300 guiding movement of the bit unit 100 along a guide groove 410 which is formed in a casing 400 inserted into an adjacent boring hole 11 in a longitudinal direction.

As the ground 10 for being bored by the boring system in accordance with the present invention, there are the grounds surrounding the tunnel construction, the grounds blocking soil for a building construction such as an apartment, the grounds blocking water, etc.

The bit unit 100, as shown in FIGS. 2 and 3, is a device boring a hole by rotation, falling, etc., such as a hammer, an air hammer, a blade-type bit, etc.

The bit unit 100 may be formed in one body with the connecting rod 200, or be connected by being assembled with the connecting rod 200.

One end of the connecting rod 200 is connected with the driving device, and the other end of the connecting rod 200 is connected with the bit unit 100. And the driving device transmits driving force thereof to the bit unit 100.

Also, in case that the bit unit 100 is a hammer or an air hammer, the connecting rod 200 may be formed as a hollow in which a hydraulic device for reciprocating motion of the bit unit 100 in a boring direction may be installed, and be rotated by rotation driving of the driving device.

And the connecting rod 200, as shown in FIG. 1, may be formed with a screw 210 for discharging soil generated in boring.

The guide unit 300 is comprised of a guide rod 310 which is connected with the connecting rod 200 at one side, and inserted into the guide groove 410.

And in an outer side of the guide rod 310 is further installed a friction reduction unit 320 for reducing friction resistance with the guide groove 410.

The friction reduction unit 320, as shown in FIG. 1, may be comprised of a plurality of rollers 321 installed in the outer side of the guide rod 310.

The rollers 321 may be embodied in various forms, as shown in FIG. 5, may be installed in the guide rod 310 by a roller shaft 322 rotatably installed to the guide rod 310.

And the guide unit 300 may be comprised of in plural, and the plurality of the guide units 300 may be installed in order in a longitudinal direction of the connecting rod 200.

The cross section of the guide rod 310 may correspond to the cross section of the guide groove 410, and as shown in FIG. 5, the width of the cross section of the rod may decrease toward a portion thereof connected with the connecting rod 200 in order to prevent the guide unit 300 from separating from the guide groove 410 due to pressing in a cross shaft direction.

The cross section of the guide unit 300, as shown in FIG. 5, may have a 'U' shape of which opening portion of the guide unit 300 is connected with the roller 321.

The guide unit 300 may be screw-connected with the connecting rod 200 by a bolt, or connected with the connecting rod 200 by welding, etc. Herein, preferably an opening portion of the guide unit 300 may be wider than a connecting portion connected with the connecting rod 200.

The guide unit 300, as shown in FIG. 1, may be further installed with a rotation prevention unit 330 for preventing the guide unit 300 from rotating due to rotation of the connecting rod 200. And the rotation prevention unit 330 may be comprised of a bearing 331. And the bearing 331 is connected to an outer surface of the connecting rod 200, and an outer surface of the bearding 331 may be connected with the guide unit 300.

In other words, the bearing 331, as shown in FIG. 1, prevents the guide unit 300 from rotating due to the transmission of the rotation to the guide unit 300 to the connecting rod 200.

The bearing 331, as shown in FIG. 1, is installed in the connecting rod 200, and the outer side of the bearing 331 is connected with the guide unit 300 by a connecting member 332.

Meanwhile, the boring system may be further comprised of an auxiliary casing 400 inserted into the adjacent boring hole 11 and formed with a guide groove 410 along the auxiliary casing 400 in a longitudinal direction for being inserted with the guide unit 300 and guiding the guide unit 300, that to say, a casing 400 inserted into the adjacent boring hole 11, as an additional element.

Meanwhile, the guide unit 300, as shown in FIG. 1, may be extended from an end of the bit unit 100.

In other words, in other to prevent soil generated during the boring of the bit unit 100 from flowing in the guide groove 410 of the adjacent casing 400 and interfering with the movement of the guide unit 300, as shown in FIG. 5, the length L2 of the guide unit 300 may be preferably larger than the length L1 of the bit unit 100.

Herein, by only moving the connecting rod when the guide unit 300 reaches the end of the guide groove 410, the depths of the boring holes 11 may be uniform.

Meanwhile, the boring system in accordance with the present invention may be further comprised of a main casing 500 covering the outer surfaces of the bit unit 100 and the connecting rod 200.

In other words, the boring system in accordance with the second embodiment of the present invention, as shown in FIGS. 4 to 8, a bit unit 100 for boring the ground 10, a connecting rod 200 connected with a driving device (not shown) for transmitting driving force to the bit unit 100, a main casing 500 inserted with the connecting rod 200, and a guide unit 300 connected with the outside of the main casing 500 in a longitudinal direction, the guide unit 300 guiding movement of the bit unit 100 along a guide groove 410 which is formed in a casing 400 inserted into an adjacent boring hole 11 in a longitudinal direction.

The guide unit 300, as shown in FIGS. 4 to 8, is a guide rod 310 connected with the main casing 500 in one side and inserted into the guide groove 410.

The guide rod 310 is connected with the main casing 500 by a screw or welding, etc.

And the guide unit 300 may be comprised of in plural, and the plurality of the guide units may be installed in order in a longitudinal direction of the main casing 500.

And preferably the width of the cross section of the guide rod 310 may decrease toward a portion thereof connected with the main casing 500 in order to prevent the guide rod 310 from separating from the guide groove 410. Or the width of the opening portion of the guide unit 300 may be greater than the width of the connecting portion connected with the main casing 500.

The guide unit 300, as shown in FIGS. 4 to 8, may be further comprised of a rotation prevention unit 331 for preventing the guide unit 300 from rotating due to rotation of the main casing 500.

The rotation protection unit 331 may be a bearing. And the bearing may be connected to an outer surface of the main casing 500, and an outer surface of the bearding may be connected with the guide unit 300. That is to say, the bearing may be embodied in various forms, as shown in FIGS. 4 to 8, may be comprised of a bearing housing 331*a* connected with the outer surface of the main casing 500, the outer surface of the bearing housing 331*a* being connected with the guide unit 300, and a plurality of balls received in the bearing housing 331*a*.

The boring system in accordance with the second embodiment of the present invention may have identical or similar constructions with the first embodiment of the present invention, and detailed description has been omitted for convenience sake.

Hereinafter, the operation of the boring system and the boring method according to the present invention will be described.

The boring system and the boring method in accordance with the present invention, as shown in FIGS. 9 to 14, relates to constructing method for boring the ground 10, the boring method in accordance with the present invention is comprised of the first boring step S1 for boring first boring hole 11 in the ground 10, casing inserting step S2 for inserting a casing 400 formed with a guide groove 410 in a longitudinal direction, and second boring step S3 for boring second boring hole 12 with a bit unit 100 moving along the guide groove 410 of the casing 400 in a longitudinal direction.

The first boring step S1, as shown in FIG. 9, is for forming the boring hole 11, a step for forming the boring hole 11 by a general boring system or the boring system of the present invention.

And in the boring hole 11, as in the step S2 and FIG. 10, is inserted with a casing formed with a guide groove 410 at one or both sides thereof. Herein it is preferable that the casing inserted with a protection pile (not shown) in the guide groove 410 be inserted into the boring hole 11 in order to prevent soil from flowing into the guide groove 410. And the protection pile inserted in the guide groove 410 is removed for boring the second boring hole 12.

After inserting the casing 400, as in step S3 and FIG. 11, the guide unit 300 is inserted into the guide groove 410, the guide unit 300 moves along the guide groove 410, and the bit unit 100 connected with the guide unit 300 bores the second boring hole 12 parallel with the first boring hole 11. Herein, forming the guide unit 300 longer than the bit unit 100 may prevent soil from flowing into the guide groove 410 during boring.

As shown in FIG. 12, by only moving the connecting rod and stopping the main casing 500 when the guide unit 300 reaches the end of the guide groove 410, the depths of the boring holes 11 may be uniform.

As shown in FIG. 13, a casing 400 is inserted into the bored boring hole 12, and as shown in FIG. 14, an auxiliary pile 420 for connecting the casings 400 and forming a wall for blocking soil or water, may be inserted.

Herein an air hammer, etc. may be used in case of boring the ground 10 having rock layers.

The invention claimed is:

1. A boring system comprising:

a bit unit for boring a ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in the longitudinal direction, wherein the guide unit is a guide rod connected with the connecting rod in one side, and inserted into the guide groove, and wherein a friction reduction unit for reducing friction resistance with the guide groove is further installed in outer side of the guide rod.

2. The boring system of claim 1, wherein the guide unit is comprised of plural guide units, and the plurality of the guide units are installed in order in a longitudinal direction of the connecting rod.

3. The boring system of claim 1, wherein the cross section of the guide rod corresponds to the cross section of the guide groove.

4. The boring system of claim 1, wherein the width of the cross section of the guide rod decreases toward a portion thereof connected with the connecting rod.

5. The boring system of claim 1, wherein the bit unit is one of an air hammer and a blade-type bit.

6. The boring system of claim 1, wherein an outer surface of the connecting rod is formed with a screw.

7. The boring system of claim 1, wherein the guide unit further comprises a bearing for preventing the guide unit from being rotated due to rotation of the connecting rod.

8. The boring system of claim 1, further comprising:

an auxiliary casing inserted into the adjacent boring hole and formed with a guide groove along the auxiliary casing in a longitudinal direction for being inserted with the guide unit and guiding the guide unit.

9. The boring system of claim 1, wherein the guide unit is extended from an end of the bit unit.

10. A boring system comprising:

a bit unit for boring a ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in the longitudinal direction, wherein the guide unit is a guide rod connected with the connecting rod in one side, and inserted into the guide groove, and a friction reduction unit comprising a plurality of rollers installed in the outer side of the guide rod.

11. A boring system comprising:

a bit unit for boring a ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in the longitudinal direction, wherein the guide unit is a guide rod connected with the connecting rod in one side, and inserted into the guide groove, and wherein the cross section of the guide unit has a 'U' shape and an opening portion of the guide unit is connected with a roller.

12. The boring system of claim 11, wherein the guide unit is connected with the connecting rod by screw or welding.

13. The boring system of claim 11, wherein an opening portion of the guide unit is wider than a connecting portion connected with the connecting rod.

14. A boring system comprising:

a bit unit for boring a ground, a connecting rod connected with a driving device for transmitting driving force to the bit unit, and a guide unit connected with the connecting rod in a longitudinal direction, the guide unit guiding movement of the bit unit along a guide groove which is formed in a casing inserted into an adjacent boring hole in the longitudinal direction, wherein the guide unit further comprises a bearing for preventing the guide unit from rotating due to rotation of the connecting rod, and wherein the bearing is connected to an outer surface of the connecting rod and an outer surface of the bearing is connected with the guide unit.

15. A boring system comprising:

a bit unit for boring the ground, a connecting rod connected with a driving device for transmitting driving force to the bit unit, a main casing inserted with the connecting rod, and a guide unit connected with the outside of the main casing in a longitudinal direction, the guide unit guiding movement of the bit unit along a guide groove which is formed in a casing inserted into an adjacent boring hole in a longitudinal direction, wherein the guide unit is a guide rod connected with the main casing in one side and inserted into the guide groove, and wherein a friction reduction unit for reducing friction resistance with the guide groove is further installed in outer side of the guide rod.

16. The boring system of claim 15, wherein the guide unit is comprised of a plurality of the guide units installed in order in a longitudinal direction of the main casing.

17. The boring system of claim 15, wherein the cross section of the guide rod corresponds to the cross section of the guide groove.

18. The boring system of claim 15, wherein the width of the cross section of the guide rod decreases toward a portion thereof connected with the main casing.

19. The boring system of claim 15, wherein the bit unit is one of an air hammer and a blade-type bit.

20. The boring system of claim 15, wherein an outer surface of the connecting rod is formed with a screw.

21. The boring system of claim 15, wherein the guide unit further comprises a bearing for preventing the guide unit from being rotated due to rotation of the connecting rod.

22. The boring system of claim 15, further comprising:

an auxiliary casing inserted into the adjacent boring hole and formed with a guide groove along the auxiliary casing in a longitudinal direction for being inserted with the guide unit and guiding the guide unit.

23. The boring system of claim 15, wherein the guide unit is extended from an end of the bit unit.

24. A boring system comprising:

a bit unit for boring the ground, a connecting rod connected with a driving device for transmitting driving force to the bit unit, a main casing inserted with the connecting rod, and a guide unit connected with the outside of the main casing in a longitudinal direction, the guide unit guiding movement of the bit unit along a guide groove which is formed in a casing inserted into an adjacent boring hole in a longitudinal direction, wherein the guide unit is a guide rod connected with the main casing in one side and inserted into the guide groove, and a friction reduction unit comprising a plurality of rollers installed in an outer side of the guide rod.

25. A boring system comprising:

a bit unit for boring the ground, a connecting rod connected with a driving device for transmitting driving force to the bit unit, a main casing inserted with the connecting rod, and a guide unit connected with the outside of the main casing in a longitudinal direction, the guide unit guiding movement of the bit unit along a guide groove which is formed in a casing inserted into an adjacent boring hole in a longitudinal direction, wherein the guide unit is a guide rod connected with the main casing in one side and inserted into the guide groove, and wherein the cross section of the guide unit has a 'U' shape and an opening portion of the guide unit is connected with a roller.

26. The boring system of claim 25, wherein the guide unit is connected with the main casing by a screw.

27. The boring system of claim 25, wherein an opening portion of the guide unit is wider than a connecting portion connected with the main casing.

28. A boring system comprising:

a bit unit for boring the ground, a connecting rod connected with a driving device for transmitting driving force to the bit unit, a main casing inserted with the connecting rod, and a guide unit connected with the outside of the main casing in a longitudinal direction, the guide unit guiding movement of the bit unit along a guide groove which is formed in a casing inserted into an adjacent boring hole in a longitudinal direction, wherein the guide unit further comprises a bearing for preventing the guide unit from being rotated due to rotation of the connecting rod, and wherein the bearing is connected to an outer surface of the main casing, and an outer surface of the bearing is connected with the guide unit.

* * * * *